US005917293A

United States Patent [19]

Saito et al.

[11] Patent Number: 5,917,293

[45] **Date of Patent: *Jun. 29, 1999**

[54] RADIO-FREQUENCY ACCELERATING SYSTEM AND RING TYPE ACCELERATOR PROVIDED WITH THE SAME

[75] Inventors: Kazuyoshi Saito, Hitachi; Kazuo Hiramoto, Hitachiohta; Junichi Hirota, Hitachi, all of Japan

[73] Assignee: Hitachi, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/760,869

[22] Filed: Dec. 9, 1996

[30] Foreign Application Priority Data

Dec. 14, 1995 [JP] Japan ..... 7-325380

[51] Int. Cl.[6] ..... H05H 9/00; H05H 15/00; H01J 23/00; H01J 23/34

[52] U.S. Cl. ..... 315/505; 315/500; 315/503

[58] Field of Search ..... 315/500, 503, 315/505

[56] References Cited

U.S. PATENT DOCUMENTS

| | | | |
|---|---|---|---|
| 4,047,068 | 9/1977 | Ress et al. . | |
| 4,730,166 | 3/1988 | Birx et al. . | |
| 4,763,079 | 8/1988 | Neil . | |
| 5,168,241 | 12/1992 | Hirota et al. | 315/500 |
| 5,661,366 | 8/1997 | Hirota et al. . | |

FOREIGN PATENT DOCUMENTS

| | | |
|---|---|---|
| 0 711 101 A1 | 5/1996 | European Pat. Off. . |
| 705879 | 4/1941 | Germany . |
| 63-76299 | 6/1988 | Japan . |
| 7-161500 | 6/1995 | Japan . |
| 365765 | 1/1963 | Switzerland . |

OTHER PUBLICATIONS

"High Frequency Accelerating Cavity for Proton Synchrontron", High Energy Device Seminar OHO 1989, pp. V–19 to V–30, Sep. 1989.

"Induction Linear Accelerators and Their Applications", J. Leiss, IEEE Transaction on Nuclear Science, vol. NS–26, No. 3, Jun. 1979, pp. 3870–3876.

"Multichannel Hybrid Power Splitter for Meter and Decimeter Wavelength Range", Mikhailov et al, Instruments and Experimental Techniques (USA), vol. 21, No. 1, pt. 2, Jan./Feb. 1978.

"A Pulsed Power Design for Laboratory Microfusion Facility", D. Smith et al, Digest of Technical Papers, 9th IEEE International Pulsed Power Conference, vol. 1, pp. 419–422.

"A Coaxial–Type Accelerating System with Amorphous Material", Krasnopolsky, Proceedings of the 1993 Particle Accelerator Conference, vol. 2, pp. 933–935.

"RF Accelerating System for Tarn II", K. Sato et al, Institute for Nuclear Study, University of Tokyo, Proc. 11th Int. Conf. on Cyclotrons and their Applications.

*Primary Examiner*—Frank G. Font
*Assistant Examiner*—Mack Haynes
*Attorney, Agent, or Firm*—Antonelli, Terry, Stout & Kraus, LLP

[57] ABSTRACT

In a radio-frequency accelerating system, a loop antenna is coupled with at least one of a plurality of magnetic core groups each including a plurality of magnetic cores or with at least one of the plurality of magnetic cores, and an impedance adjusting means is connected to the loop antenna. A relatively low voltage is applied to the impedance adjusting means. Therefore, the impedance adjusting means may be a circuit element having a low withstand voltage and hence the radio-frequency accelerating system can be formed to have a small construction.

24 Claims, 5 Drawing Sheets

RADIO-FREQUENCY ACCELERATING SYSTEM AND RING TYPE ACCELERATOR PROVIDED WITH THE SAME

BACKGROUND OF THE INVENTION

Matching of the respective impedances of a radio-frequency accelerating system (hereinafter referred to as a RF accelerating system") and a power supply is essential to the efficient acceleration of a charged particle beam. Continuous monitoring of the accelerating gap voltage is indispensable to the stable acceleration of a charged particle beam. In a conventional RF accelerating system, an impedance adjusting circuit element and an accelerating gap voltage measuring circuit element are connected directly to an accelerating gap 2 as shown in FIG. 8(*a*).

FIG. 8(*a*) shows a tuned RF accelerating system by way of example. The revolving frequency of a charged particle beam circulating through a ring type accelerator increases gradually as the charged particle beam is accelerated by a RF accelerator 1. The frequency of power supplied from a RF power supply 8 is varied in synchronism with the increasing revolving frequency of the charged particle beam to achieve a stable acceleration of the charged particles of the charged particle beam, thereby to raise the level of energy of the charged particle beam to an ultimate level of energy. In the tuned RF accelerating system, a capacitor 15 having an appropriate capacitance is connected across an accelerating gap 2 having an inner conductor 3 on opposite sides thereof, and the magnetic permeability of a magnetic core 4 is varied so that the resonant frequency of the RF accelerator 1 coincides with the frequency of the power supplied by the RF power supply 8 corresponding to the revolving frequency of the charged particle beam to accelerate the charged particle beam efficiently.

FIG. 8(*b*) shows an untuned RF accelerating system by way of example. The frequency of power supplied from a RF power supply 8 is varied in synchronism with the revolving frequency of a charged particle beam to achieve stable acceleration of the charged particle beam. In the untuned RF accelerating system, a resistor 6 is connected across an accelerating gap 2 to reduce the acuteness of resonance (Q value) of a RF accelerator 1 in order that a voltage at frequencies in a wide frequency range can be generated in the accelerating gap 2. Therefore, the untuned RF accelerating system does not need any control operation for making the resonant frequency of the RF accelerator 1 coincide with the frequency of the power supplied from the RF power supply 8 corresponding to the revolving frequency of the charged particle beam.

FIG. 8(*c*) shows a RF accelerating system in which a capacitor voltage divider 7 is connected across an accelerating gap 2 to measure accelerating gap voltage, i.e., voltage across the accelerating gap 2.

These prior art RF accelerating systems are mentioned in "OHO '89 Ko-Enerugi Kasokuki Semina", Chapter 5, "Yoshi Shinkurotoron no Ko-shuha Kasoku Sochi", pp. 19–32, Ko-Enerugi Kasokuki Kagaku Kenkyu Shorei-kai, and "Conceptual Design of a Proton Therapy Synchrotron for Loma Linda University Medical Center", pp. 25–27, Fermi National Accelerator Laboratory, 1986.

In the conventional RF accelerating system, the circuit element for impedance adjustment and the circuit element for accelerating gap voltage measurement are connected directly to the accelerating gap. Since the voltage across the accelerating gap for accelerating the charged particle beam is high, these circuit elements need to have a high withstand voltage. In particular, the capacitor among those circuit elements needs to be a large vacuum capacitor having a high withstand voltage. When such a large vacuum capacitor is connected across the accelerating gap, the structure around the accelerating gap becomes large and complicated, and such a large, complicated structure is difficult to assemble and disassemble.

A RF resistor having a high withstand voltage dissipates much power and is difficult to manufacture and hence it is difficult to generate a high accelerating gap voltage in an untuned RF accelerating system.

SUMMARY OF THE INVENTION

The present invention relates to a construction for a RF accelerating system for accelerating a charged particle beam and, more particularly, to a RF accelerating system for a ring type synchrotron, for accelerating a charged particle beam circulating through the ring type synchrotron.

Accordingly, it is an object of the present invention to provide a RF accelerating system that enables impedance adjustment and accelerating gap voltage measurement by using circuit elements having a low withstand voltage, even if the accelerating gap voltage is high, and that has a small construction and is capable of being easily assembled and disassembled.

According to a first aspect of the present invention, a loop antenna is coupled with magnetic cores of at least one of a plurality of magnetic core groups each including a plurality of magnetic cores, and an impedance adjusting means is connected to the loop antenna.

According to a second aspect of the present invention, a loop antenna is coupled with at least one magnetic core, and an impedance adjusting means is connected to the loop antenna.

When the impedance adjusting means is thus connected to the loop antenna, only a low voltage is applied to the impedance adjusting means. Therefore, the impedance adjusting means may be a circuit element having a low withstand voltage, so that the RF accelerating system can be formed to have a small construction.

According to a third aspect of the present invention, a loop antenna is coupled with magnetic cores of at least one of a plurality of magnetic core groups each including a plurality of magnetic cores, and a voltage measuring means for measuring accelerating gap voltage is connected to the loop antenna.

According to a fourth aspect of the present invention, a loop antenna is coupled with at least one magnetic core, and a voltage measuring means for measuring accelerating gap voltage is connected to the loop antenna.

When the voltage measuring means is thus connected to the loop antenna, only a low voltage is applied to the voltage measuring means. Therefore, the voltage measuring means may be a circuit element having a low withstand voltage, so that the RF accelerating system can be formed to have a small construction. Since the accelerating gap voltage can be measured by providing a RF accelerating system with at least one accelerating gap voltage measuring means, the construction of the RF accelerating system can further be reduced.

According to a fifth aspect of the present invention, a voltage measuring means is connected in series and hence the accelerating gap voltage can accurately be measured.

According to a sixth aspect of the present invention, the foregoing RF accelerating system is employed in a ring accelerator.

DETAILED DESCRIPTION OF THE PREFERRED EMBODIMENTS

First Embodiment

Figure 1:
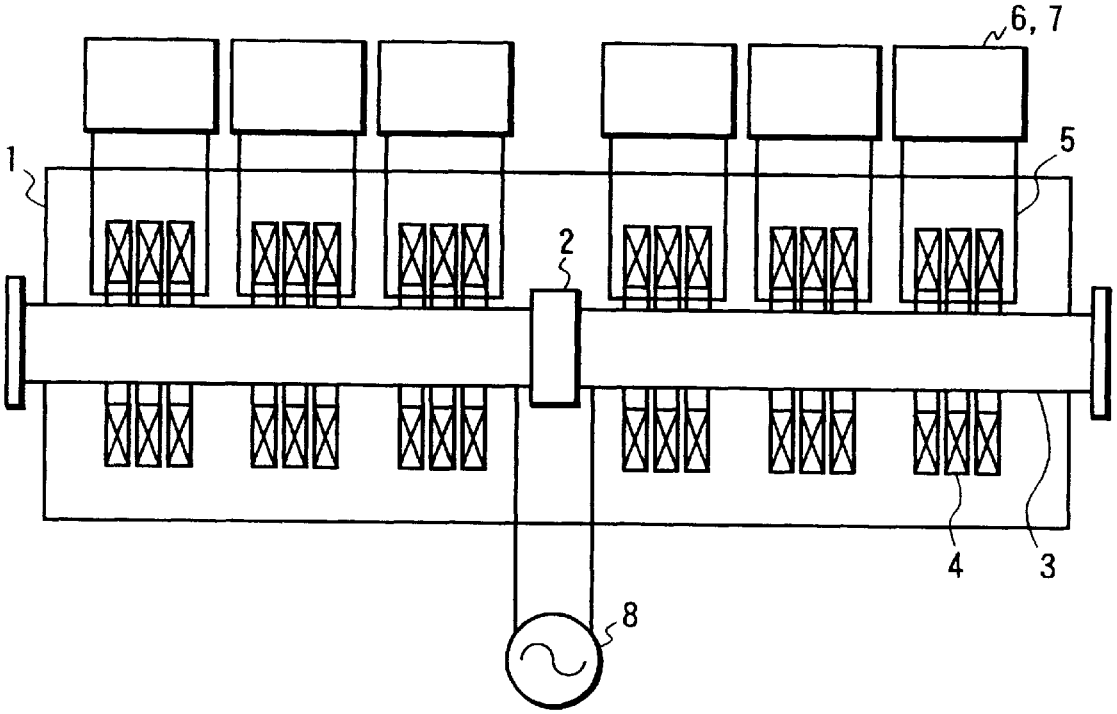
FIG. 1 is a typical view of a RF accelerating system in a first embodiment according to the present invention.

Referring to FIG. 1, which shows a RF accelerating system 1 in a first embodiment according to the present invention, the RF accelerating system 1 has an accelerating gap 2 which creates an electric field for accelerating a charged particle beam, an inner conductor 3 extending on the opposite sides of the accelerating gap 2 to form a path for the charged particle beam, and toroidal magnetic cores 4 surrounding the inner conductor 3. The magnetic cores 4 are divided into a plurality of magnetic core groups, and a loop antenna 5 is coupled with each magnetic core group. An impedance adjusting device 6 or an accelerating gap voltage measuring device 7 is connected to each loop antenna 5. Two loop antennas may be coupled with each magnetic core group of magnetic cores 4, and the impedance adjusting device 6 and the accelerating gap voltage measuring device 7 may be connected to the two loop antennas, respectively.

The impedance adjusting device 6 is a capacitor, a resistor, an induction coil, or a circuit including those circuit elements. A capacitor or an induction coil is employed for resonant frequency adjustment, and a resistor is employed for adjusting the Q value, a measure of the acuteness of resonance.

The accelerating gap voltage measuring device 7 is a capacitor voltage divider, a resistor voltage divider or a combination of those circuit elements. A voltage that appears across the impedance adjusting device 6 or the accelerating gap voltage measuring device 7 is a voltage equal to the quotient of the accelerating gap voltage divided by the number of the magnetic core groups of magnetic cores 4. In this embodiment, the voltage that appears across the impedance adjusting device 6 or the accelerating gap voltage measuring device 7 is ⅙ of the accelerating gap voltage.

A voltage that appears across the impedance adjusting device 6 or the accelerating gap voltage measuring device 7 is lower when the number of the magnetic core groups of magnetic cores 4 is greater. In an ultimate state where each magnetic core group has one magnetic core 4, a voltage that appears across the impedance adjusting device 6 or the accelerating gap voltage measuring device 7 is equal to the quotient of the accelerating gap voltage divided by the number of the magnetic cores 4.

Since the voltage applied to the impedance adjusting device 6 or the accelerating gap voltage measuring device 7 is reduced, the impedance adjusting device 6 or the accelerating gap voltage measuring device 7 may be such as to have a low withstand voltage and a small size.

Although the loop antenna 5 is coupled with each magnetic core group of the magnetic cores 4, and the impedance adjusting device 6 or the accelerating gap voltage measuring device 7 is connected to the loop antenna 5 in this embodiment, the configuration of the RF accelerating system 1 is not limited thereto. For example, if the influence of the difference in characteristics and position between the magnetic cores 4 on the RF characteristics of the RF accelerating system 1 is ignorable, only one set of a loop antenna 5 and an accelerating gap voltage measuring device 7 is necessary for measuring the accelerating gap voltage across the accelerating gap 2. If the number of the impedance adjusting devices 6 or the accelerating gap voltage measuring devices 7 is reduced, the RF accelerating system 1 can be formed to have a smaller construction.

If the number of the impedance adjusting devices 6 is increased, the accuracy of impedance adjustment over the entire length of the RF accelerating system 1 can be improved.

Even if the accelerating gap voltage of the RF accelerating system 1 is as high as 10 kV, impedance adjustment or accelerating gap voltage measurement can be achieved by using a small RF circuit element of the type available on the market and having a withstand voltage of 1 kV or below. Accordingly, the RF accelerating system 1 can be formed to have a small construction which is easy to assemble and disassemble.

Second Embodiment

Figure 2:
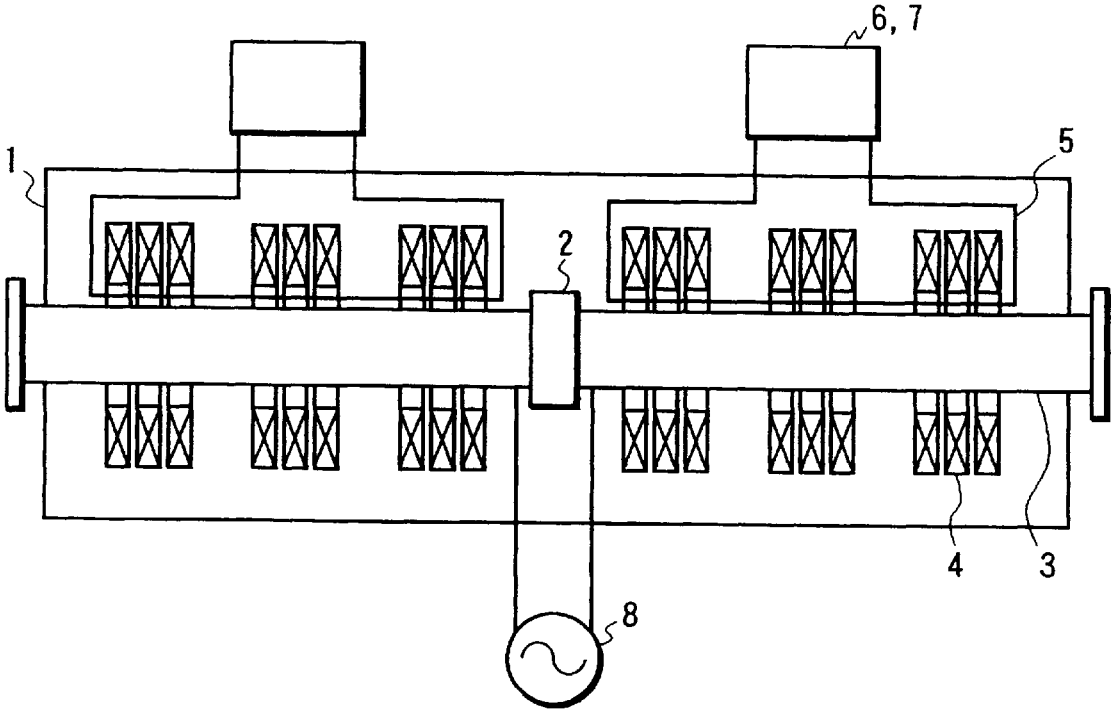
FIG. 2 is a typical view of a RF accelerating system in a second embodiment according to the present invention.

Referring to FIG. 2, which shows a RF accelerating system 1 in a second embodiment according to the present invention, a loop antenna 5 is coupled with a plurality of magnetic core groups each comprising a plurality of magnetic cores 4, and an impedance adjusting device 6 or an accelerating gap voltage measuring device 7 is connected to the loop antenna 5. A voltage that appears across the impedance adjusting device 6 or the accelerating gap voltage measuring device 7 is half the accelerating gap voltage across an accelerating gap 2. Although the effect of the second embodiment on reducing the voltage applied to the impedance adjusting device 6 or the accelerating gap voltage measuring device 7 is lower than that of the first embodiment, the impedance adjusting device 6 or the accelerating gap voltage measuring device 7 may be small and have a low withstand voltage. Since the number of loop antennas 5, impedance adjusting devices 6 or accelerating gap voltage measuring devices 7 is small, the RF accelerating system 1 can be formed to have a small construction.

Third Embodiment

Figure 3:
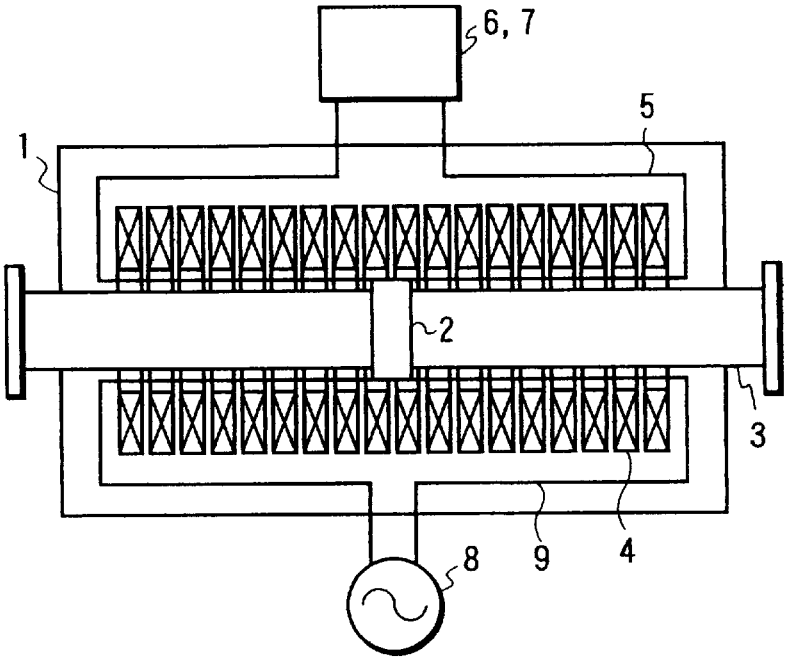
FIG. 3 is a typical view of a RF accelerating system in a third embodiment according to the present invention.
Figure 8A:
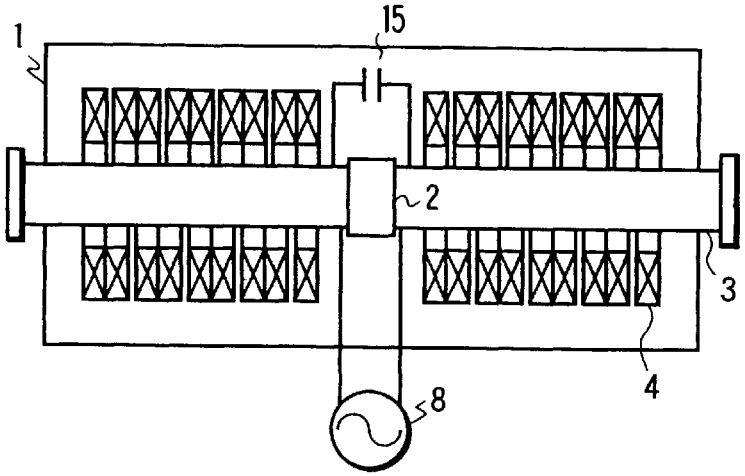
FIG. 8(a) (PRIOR ART)
FIGS. 8(*a*) to 8(*c*) are views typical of conventional RF accelerating system.
Figure 8B:
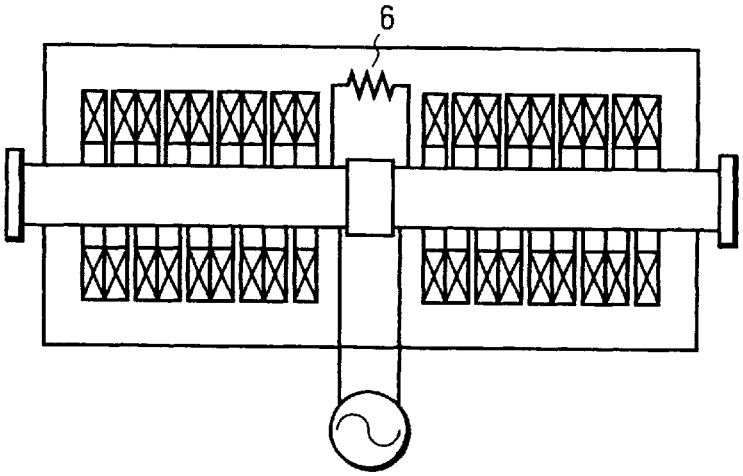
FIG. 8(b) (PRIOR ART)
Figure 8C:
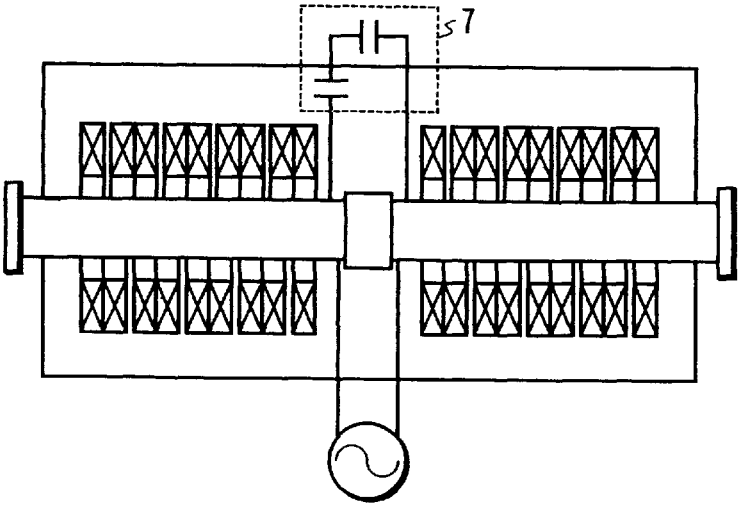
FIG. 8(c) (PRIOR ART)

Referring to FIG. 3, which shows a RF accelerating system 1 in a third embodiment according to the present invention, a loop antenna 5 is coupled with all magnetic cores 4, and an impedance adjusting device 6 or an accelerating gap voltage measuring device 7 is connected to the loop antenna 5. Power is fed from a RF power supply 8 to the RF accelerating system 1 through a loop antenna 9. In the third embodiment, a voltage that appears across the impedance adjusting device 6 or the accelerating gap voltage measuring device 7 is equal to an accelerating gap voltage across an accelerating gap 2 and the third embodiment has no effect on reducing the voltage that appears across the impedance adjusting device 6 or the accelerating gap voltage measuring device 7. However, since the third embodiment is not provided with any devices corresponding to the feeders and the vacuum capacitor or the resistor of the conventional RF accelerating system shown in FIGS. 8(*a*) to 8(*c*), magnetic cores 4 can be disposed in a space around an accelerating gap 2. Consequently, the RF accelerating system 1 in the third embodiment can be formed to have a short length. Since no circuit element is connected to the inner conductor 3, the freedom of design of the construction of the RF accelerating system 1 is enhanced and the RF accelerating system 1 is easy to assemble and disassemble. The first and the second embodiment are able to give the same effect as the third embodiment gives when the first and the second embodiment employ a loop antenna for receiving power from the RF power supply 8.

Fourth Embodiment

Figure 4:
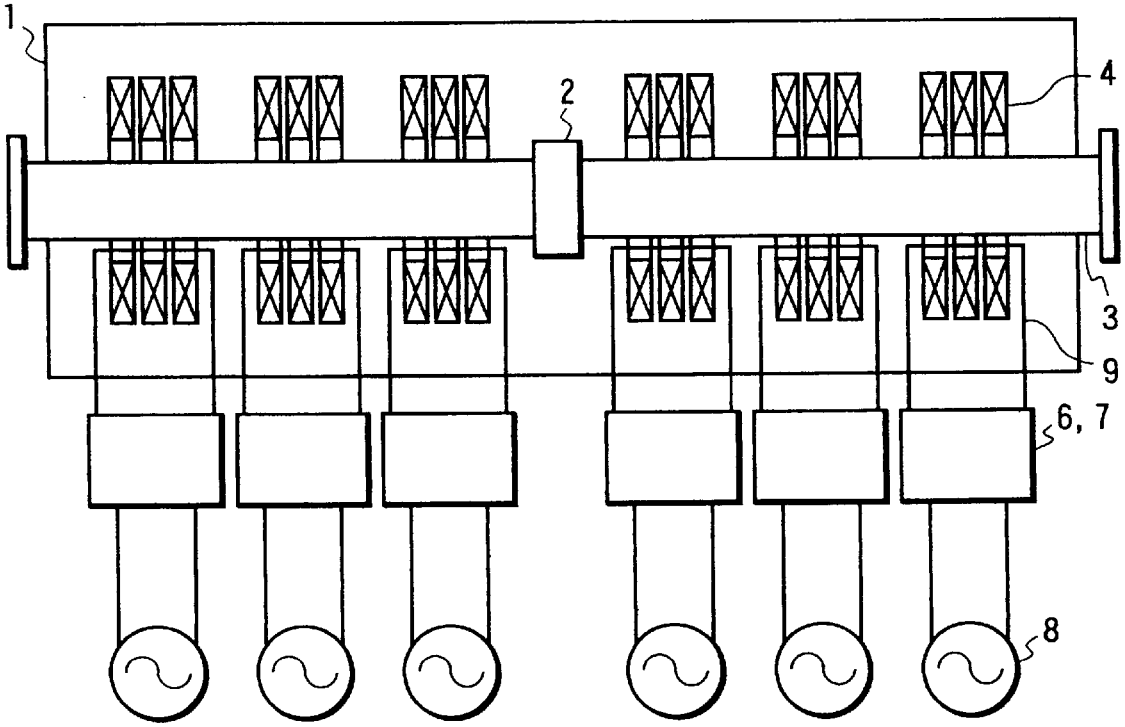
FIG. 4 is a typical view of a RF accelerating system in a fourth embodiment according to the present invention.

Referring to FIG. 4, which shows a RF accelerating system 1 in a fourth embodiment according to the present invention, magnetic cores 4 are divided into a plurality of magnetic core groups, and a feeder loop antenna 9 is coupled with each magnetic core group. Power is supplied from a multi-channel RF power supply 8 through the feeder loop antennas 9 to the RF accelerating system 1. Impedance adjusting devices 6 or accelerating gap voltage measuring devices 7 are connected to the feeder loop antennas 9, respectively. A voltage that appears across the accelerating gap 2 is equal to the sum of voltages applied to the feeder loop antennas 9, and a voltage that appears across the impedance adjusting device 6 or the accelerating gap voltage measuring device 7 is equal to the quotient of the accelerating gap voltage divided by the number of magnetic core groups. Since the voltage across the impedance adjusting devices 6 or the accelerating gap voltage measuring devices 7, like the voltage that appears across the impedance adjusting devices 6 or the accelerating gap voltage measuring devices 7 of the first embodiment, is low, the impedance adjusting devices 6 or the accelerating gap voltage measuring devices 7 may be small ones having a low withstand voltage.

The RF accelerating system 1 in this embodiment has a simple construction because additional loop antennas for impedance adjustment or accelerating gap voltage measurement are unnecessary.

Fifth Embodiment

Figure 5A:
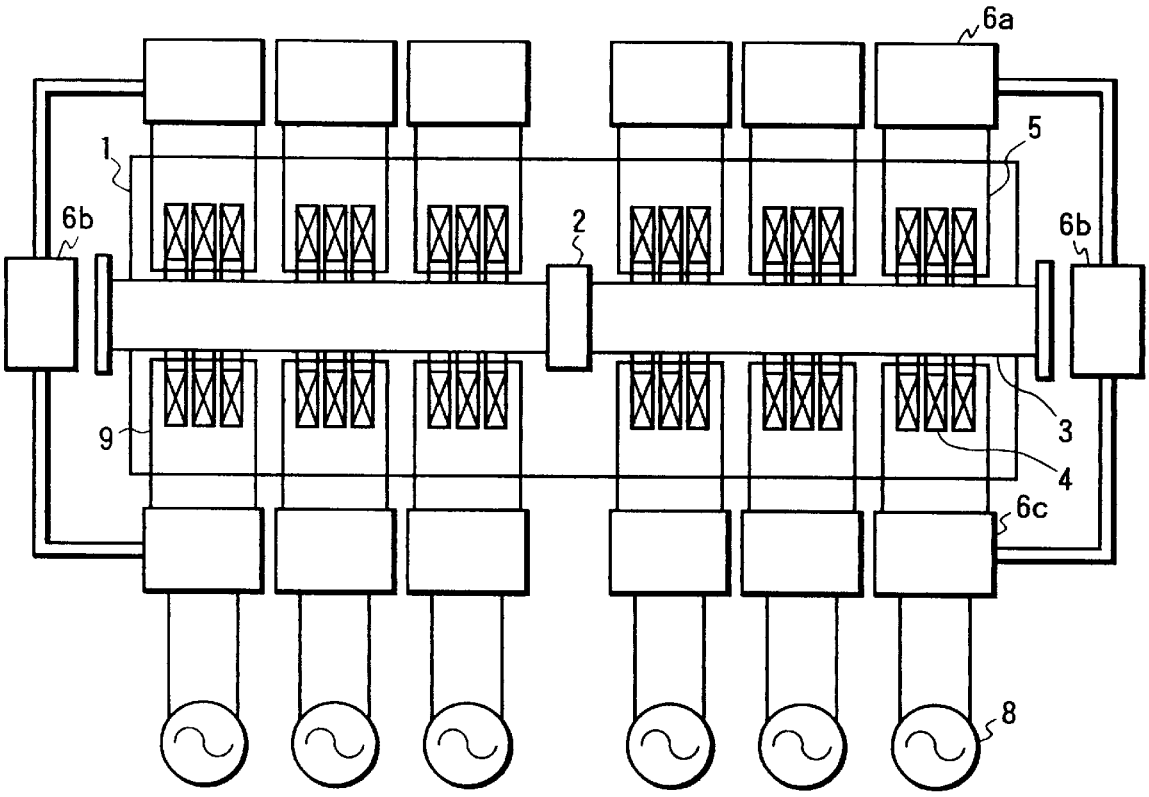
FIG. 5(*a*) is a typical view and FIG. 5(*b*) is an equivalent circuit diagram of a RF accelerating system in a fifth embodiment according to the present invention.
Figure 5B:
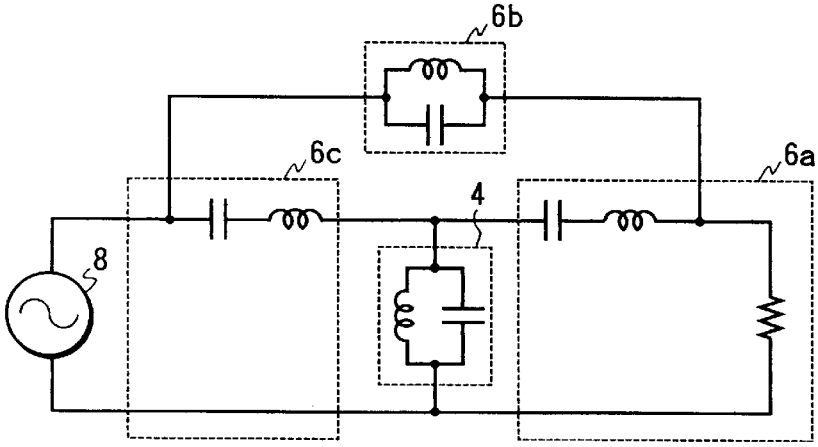

Referring to FIG. 5(*a*), which shows a RF accelerating system 1 in a fifth embodiment according to the present invention, magnetic cores 4 are divided into a plurality of magnetic core groups, and a loop antenna 5 and a feeder loop antenna 9 are coupled with each magnetic core group. Impedance adjusting devices 6*a* and 6*c* connected to the feeder loop antennas 5 form a circuit together with other impedance adjusting devices 6*b* and the magnetic cores 4 (parallel LC circuit). In this embodiment as seen in FIG. 5(*b*), a bridged-T circuit is formed to adjust the frequency characteristics of voltage that appears across an accelerating gap 2.

A voltage equal to the quotient of the accelerating gap voltage divided by the number of magnetic core groups of the magnetic cores 4 is applied to the loop antennas 5 and the feeder loop antennas 9, and hence a low voltage is applied to the impedance adjusting devices 6. Therefore, the impedance adjusting devices may be small ones having a low withstand voltage.

The size of the RF accelerating system can further be reduced if the number of the impedance adjusting devices 6 is reduced, and further accurate impedance adjustment over the entire length of the RF accelerating system 1 is possible if the number of the impedance adjusting devices 6 is increased.

The impedance adjusting circuit may comprise only the impedance adjusting devices 6*c* to further reduce the size of the RF accelerating system 1.

Sixth Embodiment

Figure 6:
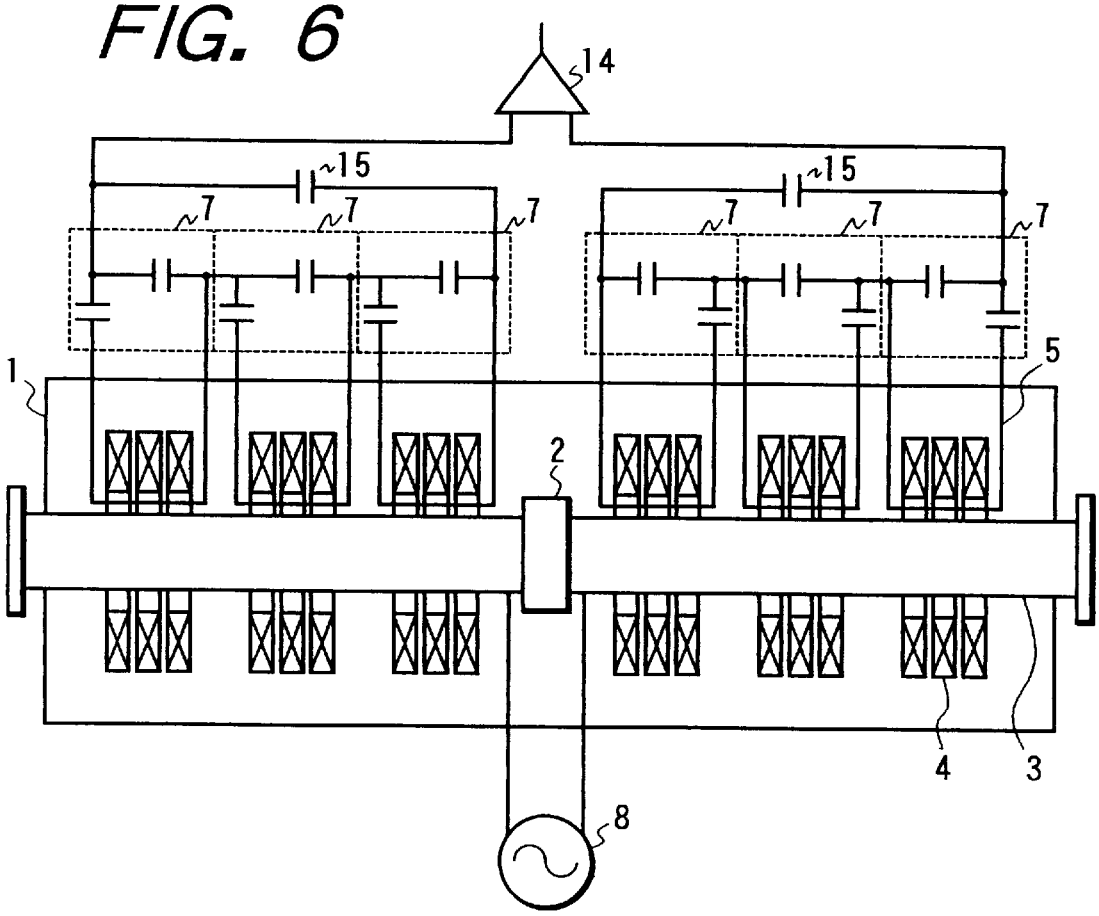
FIG. 6 is a typical view of a RF accelerating system in a sixth embodiment according to the present invention.

Referring to FIG. 6, which shows a RF accelerating system 1 in a sixth embodiment according to the present invention, magnetic cores 4 are divided into a plurality of magnetic core groups, and a loop antenna 5 is coupled with each magnetic core group. An accelerating gap voltage measuring device 7 is connected to each loop antenna 5.

The accelerating gap voltage measuring device 7 is a capacitor voltage divider. In this embodiment, the capacitor voltage dividers on the opposite sides of an accelerating gap 2 are connected in series, respectively, the difference between signals provided by those two series groups of capacitor voltage dividers is amplified by a differential amplifier 14 and, at the same time, a long transmission line extending to a control room is driven.

The voltage dividing ratio is adjusted by capacitors 15. When the RF accelerating system 1 is provided with the differential amplifier 14 and the capacitors 15, the configuration of the following signal processing system is simplified. The accuracy of accelerating gap voltage measurement is increased when the number of the capacitor voltage dividers is increased, and the size of the RF accelerating system is reduced when the same is decreased.

A voltage equal to the quotient of the accelerating gap voltage divided by the number of the magnetic core groups is applied to each loop antenna 5 and each feeder loop antenna 9. Since a low voltage is applied to the accelerating gap voltage measuring devices 7, the accelerating gap voltage measuring devices 7 may be small ones having a low withstand voltage.

The capacitor voltage divider employed in this embodiment may be replaced by a resistor voltage divider.

Seventh Embodiment

Figure 7:
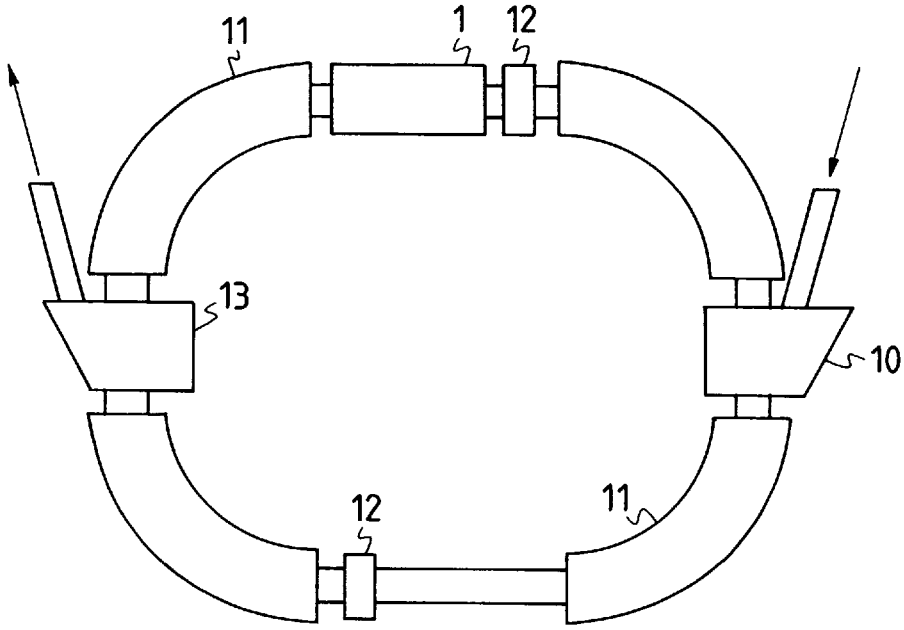
FIG. 7 is a typical view of a ring accelerator in a seventh embodiment according to the present invention.

Referring to FIG. 7, which shows a ring type accelerator in a seventh embodiment according to the present invention, the ring type accelerator comprises a beam inflector 10 through which a charged particle beam emitted by a preaccelerator, not shown, is injected, bending magnets 11 for bending the path of the charged particle beam so that the charged particle beam travels along a ring path, focusing magnets 12 for focusing the charged particle beam so that the charged particle beam may not expand, a RF accelerating system 1 for accelerating charged particles to increase the velocity of charged particles of the incident charged particle beam so that the charged particle beam has necessary energy, and a deflector 13 for extracting the charged particle beam having energy of a predetermined level.

Excitation currents supplied to the bending magnets 11 and the focusing magnets 12 need to be increased according to the acceleration of the charged particles of the charged particle beam to achieve a stable acceleration of the charged particles of the charged particle beam by the RF accelerating system 1. Since the revolving period of the charged particle beam circulating through the ring type accelerator decreases as the charged particle beam is accelerated, the frequency of the accelerating gap voltage of the RF accelerating system 1, i.e., the output frequency of the RF power supply 8, needs to be increased as the revolving period decreases. Therefore, continuous monitoring of the accelerating gap voltage is indispensable to a stable acceleration of the charged particle beam. Matching of the respective impedances of the radio-frequency accelerating system 1 and the RF power supply 8 is essential to the efficient acceleration of the charged particle beam. Such requirements can be met by employing any one of the RF accelerating systems in the first to the sixth embodiment in the ring type accelerator. Since the RF accelerating system 1 may employ a resistor having a practically sufficient withstand voltage (500 V) and dissipating practically permissible power (1 kW) even if the accelerating gap voltage of the RF accelerating system 1 is as high as 10 kV. Therefore, an untuned RF accelerating system may be employed, the control of the resonant frequency of the RF accelerating system according to the revolving period of the charged particle beam, i.e., the output frequency of the RF power supply 8, is unnecessary, and the operation of the ring type accelerator can easily be controlled.

What is claimed is:

1. A radio-frequency accelerating system comprising:

a pair of inner conductors provided with a path for a charged particle beam;

an accelerating gap formed between the pair of inner conductors, the accelerating gap creating an electric field for accelerating the charged particle beam;

a plurality of toroidal magnetic cores surrounding each of the pair of inner conductors;

a feeder apparatus for supplying radio-frequency power;

wherein the toroidal magnetic cores surrounding the inner conductors are divided into a plurality of magnetic core groups, a first loop antenna penetrates at least one of the magnetic core groups surrounding one of the pair of inner conductors, the first loop antenna being separately coupled to the feeder apparatus, and a first impedance adjusting apparatus is connected to the first loop antenna, a second loop antenna penetrates at least one of magnetic core groups surrounding another of the pair of inner conductors, the second loop antenna being separately coupled to the feeder apparatus, and a second impedance adjusting apparatus is connected to the second loop antenna.

2. A radio-frequency accelerating system according to claim 1, wherein the radio-frequency accelerating system is a part of a ring type accelerator.

3. A radio-frequency accelerating system according to claim 1, wherein one part of at least one of the first and second loop antennas coupled to the feeder apparatus penetrates at least one of the magnetic core groups surrounding the one of the pair of inner conductors, and another part of the at least one of the first and second loop antennas coupled to the feeder apparatus penetrates at least one of the magnetic core groups surrounding another of the pair of inner conductors.

4. A radio-frequency accelerating system according to claim 3, wherein the radio-frequency accelerating system is a part of a ring type accelerator.

5. A radio-frequency accelerating system comprising:

a pair of inner conductors provided with a path for a charged particle beam;

an accelerating gap formed between the pair of inner conductors, the accelerating gap creating an electric field for accelerating the charged particle beam;

a plurality of toroidal magnetic cores surrounding each of the pair of inner conductors;

a feeder apparatus for supplying radio-frequency power;

wherein a first loop antenna penetrates at least one of the plurality of magnetic cores surrounding one of the pair of inner conductors, the first loop antenna being separately coupled to the feeder apparatus, and a first impedance adjusting apparatus is connected to the first loop antenna, a second loop antenna penetrates at least one of the plurality of magnetic cores surrounding another of the pair of inner conductors, the second loop antenna being separately coupled to the feeder apparatus, and a second impedance adjusting apparatus is connected to the second loop antenna.

6. A radio-frequency accelerating system according to claim 5, wherein the radio-frequency accelerating system is a part of a ring type accelerator.

7. A radio-frequency accelerating system according to claim 5, wherein one part of at least one of the first and second loop antennas coupled to the feeder apparatus penetrates at least one of the magnetic cores surrounding the one of the pair of inner conductors, and another part of the at least one of the first and second loop antennas coupled to the feeder apparatus penetrates at least one of the magnetic cores surrounding another of the pair of inner conductors.

8. A radio-frequency accelerating system according to claim 7, wherein the radio-frequency accelerating system is a part of a ring type accelerator.

9. A radio-frequency accelerating system comprising:

a pair of inner conductors provided with a path for a charged particle beam;

an accelerating gap formed between the pair of inner conductors, the accelerating gap creating an electric field for accelerating the charged particle beam;

a plurality of toroidal magnetic cores surrounding each of the pair of inner conductors;

a feeder apparatus for supplying radio-frequency power;

wherein the toroidal magnetic cores surrounding the inner conductors are divided into a plurality of magnetic core groups, a first loop antenna penetrates at least one of the magnetic core groups surrounding one of the pair of inner conductors, the first loop antenna being separately coupled to the feeder apparatus, and a first accelerating gap voltage measuring apparatus for measuring the voltage across the accelerating gap being connected to the first loop antenna, a second loop antenna penetrates at least one of the magnetic core groups surrounding another of the pair of inner conductors, the second loop antenna being separately coupled to the feeder apparatus, and a second accelerating gap voltage measuring apparatus for measuring the voltage across the accelerating gap is connected to the second loop antenna.

10. A radio-frequency accelerating system according to claim 9, wherein the radio-frequency accelerating system is a part of a ring type accelerator.

11. A radio-frequency accelerating system according to claim 9, wherein one part of at least one of the first and second loop antennas coupled to the feeder apparatus penetrates at least one of the magnetic core groups surrounding the one of the pair of inner conductors, and another part of the at least one of the first and second loop antennas coupled to the feeder apparatus penetrates at least one of the magnetic core groups surrounding another of the pair of inner conductors.

12. A radio-frequency accelerating system according to claim 11, wherein the radio-frequency accelerating system is a part of a ring type accelerator.

13. A radio-frequency accelerating system comprising:

a pair of inner conductors provided with a path for a charged particle beam;

an accelerating gap formed between the pair of inner conductors, the accelerating gap creating an electric field for accelerating the charged particle beam;

a plurality of toroidal magnetic cores surrounding each of the pair of inner conductors;

a feeder apparatus for supplying radio-frequency power;

wherein a first loop antenna penetrates at least one of the plurality of magnetic cores surrounding one of the pair of inner conductors, the first loop antenna being separately coupled to the feeder apparatus, and a first accelerating gap voltage measuring apparatus for measuring the voltage across the accelerating gap is connected to the first loop antenna, a second loop antenna penetrates at least one of the plurality of magnetic cores surrounding another of the pair of inner conductors, the second loop antenna being separately coupled to the feeder apparatus, and a second accelerating gap voltage measuring apparatus for measuring the voltage across the accelerating gap is connected to the second loop antenna.

14. A radio-frequency accelerating system according to claim 13, wherein the radio-frequency accelerating system is a part of a ring type accelerator.

15. A radio-frequency accelerating system according to claim 13, wherein one part of at least one of the first and second loop antennas coupled to the feeder apparatus penetrates at least one of the magnetic cores surrounding the one of the pair of inner conductors, and another part of the at least one of the first and second loop antennas coupled to the feeder apparatus penetrates at least one of the magnetic cores surrounding another of the pair of inner conductors.

16. A radio-frequency accelerating system according to claim 15, wherein the radio-frequency accelerating system is a part of a ring type accelerator.

17. A radio-frequency accelerating system, comprising:

a pair of inner conductors provided with a path for a charged particle beam;

an accelerating gap formed between the pair of inner conductors, the accelerating gap creating an electric field for accelerating the charged particle beam;

a plurality of toroidal magnetic cores surrounding at least one of the pair of inner conductors;

a feeder apparatus for supplying radio-frequency power;

wherein the toroidal magnetic cores surrounding the at least one of the pair of inner conductors are divided into a plurality of magnetic core groups, a loop antenna penetrates at least one of the magnetic core groups surrounding the at least one of the pair of inner conductors, the loop antenna being separately coupled to the feeder apparatus, and a impedance adjusting apparatus is connected to the loop antenna.

18. A radio-frequency accelerating system according to claim 17, wherein the radio-frequency accelerating system is a part of a ring type accelerator.

19. A radio-frequency accelerating system, comprising:

a pair of inner conductors provided with a path for a charged particle beam;

an accelerating gap formed between the pair of inner conductors, the accelerating gap creating an electric field for accelerating the charged particle beam;

a plurality of toroidal magnetic cores surrounding at least one of the pair of inner conductors;

a feeder apparatus for supplying radio-frequency power;

wherein the loop antenna penetrates at least one of the plurality of magnetic core surrounding the at least one of the pair of inner conductors, the loop antenna being separately coupled to the feeder apparatus, and a impedance adjusting apparatus is connected to the loop antenna.

20. A radio-frequency accelerating system according to claim 19, wherein the radio-frequency accelerating system is a part of a ring type accelerator.

21. A radio-frequency accelerating system, comprising:

a pair of inner conductors provided with a path for a charged particle beam;

an accelerating gap formed between the pair of inner conductors, the accelerating gap creating an electric field for accelerating the charged particle beam;

a plurality of toroidal magnetic cores surrounding at least one of the pair of inner conductors;

a feeder apparatus for supplying radio-frequency power;

wherein the toroidal magnetic cores surrounding the inner conductor are divided into a plurality of magnetic core groups, a loop antenna penetrates at least one of the magnetic core groups surrounding the at least one of the pair of inner conductors, the loop antenna being separately coupled to the feeder apparatus, and an accelerating gap voltage measuring apparatus for measuring the voltage across the accelerating gap is connected to the loop antenna.

22. A radio-frequency accelerating system according to claim 21, wherein the radio-frequency accelerating system is a part of a ring type accelerator.

23. A radio-frequency accelerating system, comprising:

a pair of inner conductors provided with a path for a charged particle beam;

an accelerating gap formed between the pair of inner conductors, the accelerating gap creating an electric field for accelerating the charged particle beam;

a plurality of toroidal magnetic cores surrounding at least one of the pair of inner conductors;

a feeder apparatus for supplying radio-frequency power;

wherein a loop antenna penetrates at least one of the plurality of magnetic cores surrounding the at least one of the pair of inner conductors, the loop antenna being separately coupled to the feeder apparatus, and an accelerating gap voltage measuring apparatus for measuring the voltage across the accelerating gap is connected to the loop antenna.

24. A radio-frequency accelerating system according to claim 23, wherein the radio-frequency accelerating system is a part of a ring type accelerator.

* * * * *